US010005629B2

(12) United States Patent
Hojo

(10) Patent No.: US 10,005,629 B2
(45) Date of Patent: Jun. 26, 2018

(54) CONVEYANCE CONTROL OF RECORDING MEDIUM IN IMAGE FORMING APPARATUS

(71) Applicant: CANON KABUSHIKI KAISHA, Tokyo (JP)

(72) Inventor: Yuta Hojo, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/352,974

(22) Filed: Nov. 16, 2016

(65) Prior Publication Data

US 2017/0176902 A1 Jun. 22, 2017

(30) Foreign Application Priority Data

Dec. 17, 2015 (JP) ..... 2015-246635
Oct. 27, 2016 (JP) ..... 2016-210839

(51) Int. Cl.
*G03G 15/00* (2006.01)
*B65H 1/00* (2006.01)
*G03G 15/23* (2006.01)

(52) U.S. Cl.
CPC ..... *B65H 1/00* (2013.01); *G03G 15/234* (2013.01); *G03G 15/6564* (2013.01); *G03G 15/6582* (2013.01); *G03G 2215/00827* (2013.01)

(58) Field of Classification Search
CPC ..... G03G 15/234
USPC ..... 399/234
See application file for complete search history.

(56) References Cited

U.S. PATENT DOCUMENTS 6,029,041 A * 2/2000 Takano ..... G03G 15/6564 399/303
8,027,629 B2 9/2011 Tanaka
8,532,558 B2 * 9/2013 Okada ..... B41J 13/0018 347/104
8,905,509 B2 12/2014 Fujimoto
2003/0143004 A1 * 7/2003 Shimazu ..... G03G 15/234 399/396
2005/0207811 A1 * 9/2005 Kimura ..... G03G 15/6529 399/401
2006/0214974 A1 * 9/2006 Isobe ..... B41J 29/377 347/18
2006/0269339 A1 * 11/2006 Okamoto ..... G03G 15/6564 399/401
2008/0253818 A1 * 10/2008 Sasaki ..... G03G 15/238 399/401
2009/0142088 A1 6/2009 Tanaka
(Continued)

FOREIGN PATENT DOCUMENTS

JP 2001277619 A 10/2001
JP 2009139501 A 6/2009
(Continued)

*Primary Examiner* — Anthony Nguyen
(74) *Attorney, Agent, or Firm* — Fitzpatrick, Cella, Harper & Scinto

(57) ABSTRACT

An image forming apparatus may comprise a first feeding unit, a second feeding unit, a feeding control unit, an image forming unit, a reversal unit, a post-processing unit, and a post-processing control unit. Based on a post-processing time amount notified from the post-processing control unit, the feeding control unit does not allow a sheet to wait in the reversal unit and adjusts a feed time of a sheet fed from the first feeding unit so that the sheet fed from the first feeding unit does not contact with a sheet waiting in the second feeding unit.

10 Claims, 7 Drawing Sheets

(56) References Cited

U.S. PATENT DOCUMENTS

| | | | | |
|---|---|---|---|---|
| 2012/0002230 | A1* | 1/2012 | Yamazaki | B41J 3/60 358/1.13 |
| 2013/0256982 | A1* | 10/2013 | Kawanago | G03G 15/234 271/225 |
| 2014/0098154 | A1 | 4/2014 | Fujimoto | |
| 2015/0368054 | A1* | 12/2015 | Kowase | B65H 7/06 271/258.01 |

FOREIGN PATENT DOCUMENTS

| | | | |
|---|---|---|---|
| JP | 2010060822 | A | 3/2010 |
| JP | 2014073630 | A | 4/2014 |

* cited by examiner

CONVEYANCE CONTROL OF RECORDING MEDIUM IN IMAGE FORMING APPARATUS

BACKGROUND OF THE INVENTION

Field of the Invention

The present invention relates to an image forming apparatus that forms an image on a recording medium.

Description of the Related Art

A sheet that has been subjected to printing by an image forming apparatus is sometimes subjected to post-processing by a post-processing apparatus. The amount of time it takes to perform post-processing is sometimes longer than the amount of time it takes to form an image on a sheet. For this reason, the image forming apparatus discharges a successive sheet to the post-processing apparatus after waiting until the post-processing of a preceding sheet is complete. Post-processing is also sometimes applied to a sheet that has been subjected to double-sided printing. Japanese Patent Laid-Open No. 2014-73630 proposes that an interval between a sheet that has been subjected to second-surface printing and a sheet that is to be newly fed from a feeding unit in order to undergo printing on its first surface is set according to the processing time amount for post-processing applied to the sheet resulting from second-surface printing. Japanese Patent Laid-Open 2014-73630 also proposes that printing on a first surface of a sheet fed from a feeding unit and printing on a second surface of a sheet on whose first surface an image has already been formed are executed alternatingly. Thus, in the invention disclosed in Japanese Patent Laid-Open No. 2014-73630, the interval at which sheets are fed from the feeding unit is determined based on the amount of post-processing time, and thereby the interval between a sheet being fed from the feeding unit and a sheet that has been subjected to first-surface printing is determined.

Incidentally, depending on the amount of post-processing time, there are cases where the sheet that has been subjected to first-surface printing needs to wait on the conveyance path, but no consideration is given to this in the invention disclosed in Japanese Patent Laid-Open No. 2014-73630. As a result, a sheet that has been subjected to first-surface printing and is re-fed to the image forming unit for second-surface printing ends up colliding with a sheet fed from the feeding unit to the image forming unit for first-surface printing. Such collisions are particularly likely to occur in cases where the amount of post-processing time varies.

SUMMARY OF THE INVENTION

In view of this, the present invention provides an image forming apparatus in which multiple sheets are not likely to contact.

The present invention provides an image forming apparatus, comprising the following elements. A first feeding unit is configured to feed a sheet having a first surface and a second surface on which no image has been formed. A second feeding unit is configured to feed a sheet having a first surface on which an image has been formed. A feeding control unit is configured to control the first feeding unit and the second feeding unit. An image forming unit is configured to form an image on the first surface of the sheet fed by the first feeding unit and to form an image on a second surface of the sheet fed by the second feeding unit. A reversal unit is configured to reverse a conveyance direction of a sheet that was fed by the first feeding unit and has a first surface on which an image has been formed, and to convey the sheet with the first surface on which the image has been formed to the second feeding unit. A post-processing unit is configured to apply post-processing to a sheet. A post-processing control unit is configured to control the post-processing unit. Based on a post-processing time amount notified from the post-processing control unit, the feeding control unit does not allow a sheet to wait in the reversal unit and adjusts a feed time of a sheet fed from the first feeding unit so that the sheet fed from the first feeding unit does not contact with a sheet waiting in the second feeding unit.

Further features of the present invention will become apparent from the following description of exemplary embodiments (with reference to the attached drawings).

DESCRIPTION OF THE EMBODIMENTS

Figure 1:
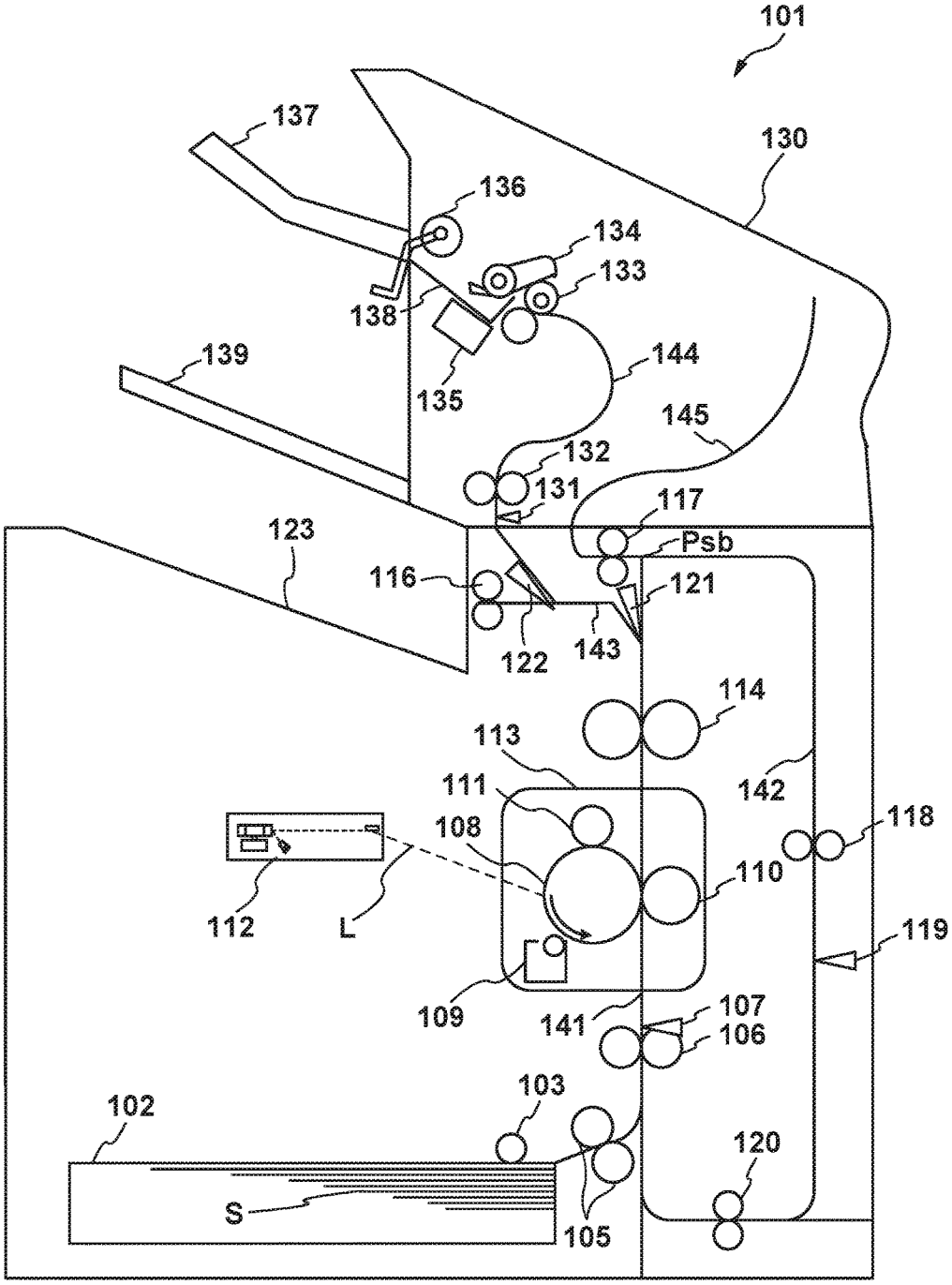
FIG. 1 is an overall schematic view of an image forming system.

In the present embodiment, in order to suppress a case in which a successive sheet enters a post-processing apparatus while the post-processing apparatus is executing post-processing on a preceding sheet, the successive sheet waits on a sub conveyance path according to an amount of post-processing time. In this case, there is a possibility that a sheet newly fed from a sheet cassette will contact with (come into contact with) the sheet waiting on the sub conveyance path. In view of this, the feed time of the sheet that is to be newly fed from the sheet cassette is also delayed according to the amount of post-processing time. Accordingly, an image forming apparatus in which multiple sheets are not likely to collide (come into contact) is provided.

Image Forming Apparatus

An image forming apparatus 101 according to the present embodiment will be described with reference to FIG. 1. A sheet cassette 102 is a holding portion that accommodates and holds multiple sheets S. A feeding roller 103 feeds sheets S from the sheet cassette 102 to the conveyance path. FR rollers 105 provided downstream of the feeding roller 103 in the conveyance direction of the sheet S convey the sheet S to a main conveyance path 141. FR is an abbreviation of "feed-retarding". Conveying rollers 106, a top sensor 107, an image forming unit 113, and a fixing device 114 are arranged on the main conveyance path 141 in the stated order from the upstream side to the downstream side. The conveyance rollers 106 furthermore convey the sheet S fed from the sheet cassette 102 to the downstream image forming unit 113. The top sensor 107 is a sheet sensor that detects the leading edge, trailing edge, or the like of the sheet S. A detection signal output by the top sensor 107 due to detecting the leading edge of the sheet S provides a reference time for controlling sheet conveyance and image formation. For example, while printing is being executed continuously on multiple sheets, after a predetermined amount of time from the time at which the top sensor 107 detected the leading edge or trailing edge of the sheet S, the feeding roller 103 feeds a subsequent sheet S. Accordingly, a desired throughput (number of images (sheets S) to be formed per unit time) is achieved.

The image forming unit 113 forms images using an electrophotographic method, for example. The image forming unit 113 includes a photosensitive drum 108, a developing device 109, a transfer roller 110, a charging roller 111, and the like. The charging roller 111 uniformly charges the surface of the photosensitive drum 108. An exposure device 112 forms an electrostatic latent image by irradiating the photosensitive drum 108 with a laser light L modulated according to an image signal. The developing device 109 develops the electrostatic latent image into a toner image by attaching toner to the electrostatic latent image. The transfer roller 110 transfers the toner image from the photosensitive drum 108 onto the sheet S. Due to being conveyed by the photosensitive drum 108 and the transfer roller 110, the sheet S is conveyed to the fixing device. The fixing device 114 applies heat and pressure to the toner image and the sheet S so as to fix the toner image to the sheet S.

The main conveyance path 141 branches into a sub conveyance path 142 and a discharge conveyance path 143, and a flapper 121 is provided at the branching position. In the case of discharging the sheet S to a discharge tray 123 or conveying the sheet S to the post-processing apparatus 130, the flapper 121 guides the sheet S to the discharge conveyance path 143. On the other hand, in the case where an image is to be formed on the second surface of a sheet S on whose first surface an image has been formed, the flapper 121 guides the sheet S to the sub conveyance path 142. The sub conveyance path 142 is also referred to as a loop path or a double-sided conveyance path in some cases. A post-processing conveyance path 144 is connected at a certain position on the discharge conveyance path 143. A flapper 122 is provided near the entrance to the post-processing conveyance path 144. The flapper 122 guides a sheet S that requires post-processing to the post-processing conveyance path 144, and guides a sheet S that does not require post-processing to discharge rollers 116. The discharge rollers 116 discharge the sheet S to the discharge tray 123.

Double-Sided Printing

A sheet S for which forming of an image on the second surface thereof has been designated by a print job is guided to a reverse conveyance path 145 that is connected at a certain position on the sub conveyance path 142. SB rollers 117 that reverse the conveyance direction of the sheet S by pulling the sheet S onto the reverse conveyance path 145 are provided on the reverse conveyance path 145. SB is an abbreviation for "switchback". The SB rollers 117 reverse their rotation directions when the trailing edge of the sheet S reaches a double-sided reversal position Psb and feed the sheet S to the sub conveyance path 142. Conveyance rollers 118 convey the sheet S on the sub conveyance path 142. A sheet sensor 119 is arranged further downstream than the conveyance rollers 118 are. After a predetermined amount of time after the sheet sensor 119 detects the leading edge of the sheet S (time when the leading edge of the sheet S is sandwiched between re-feeding rollers 120), the conveyance rollers 118 and the re-feeding rollers 120 stop. Accordingly, the sheet S transitions from a state of being conveyed to a state of waiting. Note that if the sheet conveyed on the sub conveyance path 142 is the final sheet in the print job, or the like, the image forming unit 113 can immediately form an image on the sheet S. In such a case, the sheet S can be re-fed to the main conveyance path 141 without stopping on the sub conveyance path 142. On the other hand, in some cases, the sheet S that exists on the sub conveyance path 142 is to be subjected to post-processing and the sheet S preceding that sheet S is undergoing post-processing in the post-processing apparatus 130. In such a case, the image forming apparatus 101 cannot convey the sheet S that exists on the sub conveying path 142 to the post-processing apparatus 130. The image forming unit 113 can form an image on a successive sheet S while a sheet S is waiting on the sub conveyance path 142. Accordingly, if the length of the sub conveyance path 142 is a length that can accommodate two sheets S, the image forming unit 113 can output the successive sheet S to the sub conveyance path 142 when the preceding sheet S is waiting near the re-feeding rollers 120. Because the length of the sub conveyance path 142 is limited, there is a maximum value of the number of sheets S that can wait on the sub conveyance path 142. Note that the maximum value varies depending on the length of the conveyance path 142 and the length of the sheets S. If a number of sheets S exceeding the maximum value are guided to the sub conveyance path 142, the leading edge of a sheet S conveyed from the main conveyance path 141 will contact with the trailing edge of the final sheet S among the multiple sheets S waiting on the sub conveyance path 142. Thus, if the wait location is full, it is necessary to avoid a case in which a new sheet S is guided to the sub conveyance path 142, which is the wait location. Accordingly, in order to prevent such a collision, the time of feeding the sheet S from the sheet cassette 102 needs to be suitably adjusted according to the post-processing time amount.

Post-Processing

If an instruction is given to perform post-processing on a sheet S on which an image has been formed, the flapper 122 guides the sheet S to the post-processing apparatus 130. When the leading edge of a sheet S is detected by a sheet sensor 131 provided at the entrance, the post-processing apparatus 130 starts up entrance rollers 132 and discharge rollers 133. The sheet S is delivered from the entrance rollers 132 to the discharge rollers 133. An intermediate stack section 138 at which sheets S are temporarily accumulated is provided downstream of the discharge rollers 133. A jogger 137 that aligns the position of the sheet S with predetermined positions in both the width direction and the conveyance direction of the sheet S is provided downstream of the intermediate stack section 138. A stack section, which is a set consisting of the jogger 137 and the intermediate stack section 138, is formed. Accordingly, the sheet S is stacked spanning across the jogger 137 and the intermediate stack section 138. An alignment paddle 134 is provided upstream of and above the jogger 137. The jogger 137 uses the alignment paddle 134 to align multiple sheets S in the conveyance direction. There is a discharge roller 136 on the downstream side of the alignment paddle 134. The discharge roller 136 is selectively switched between a nip state and a separated state. A stapler 135 that uses staples to bind an edge of a bundle formed by aligning multiple sheet S is provided in the intermediate stack section 138. Also, the stack section 139 is provided below the jogger 137. If the discharge roller 136 is in the nip state and the jogger 137 has moved to a retreat position, the sheets S (bundle) discharged by the discharge roller 136 are stacked in the stack section 139. If the post-processing apparatus 130 is to execute stapling, the post-processing apparatus 130 receives the sheets S with the entrance rollers 132 and sends them to the discharge rollers 133. The discharge rollers 133 convey the sheets S to the intermediate stack section 138. At this time, the discharge roller 136 is in the separated state. When the sheets S are conveyed to the intermediate stack section 138, the jogger 137 moves from the retreat position to a position at which the sheets S can be received. The jogger 137 aligns the sheets S in the width direction. Thereafter, the alignment paddle 134 aligns the sheets S in the conveyance direction. When the alignment in the conveyance direction is complete, the stapler 135 executes stapling on the bundle of sheets S. When stapling is complete, the jogger 137 retreats. Also, the discharge roller 136 transitions to the nip state, nips and conveys the sheets S, and discharges them to the stack section 139.

Control System

Figure 2:
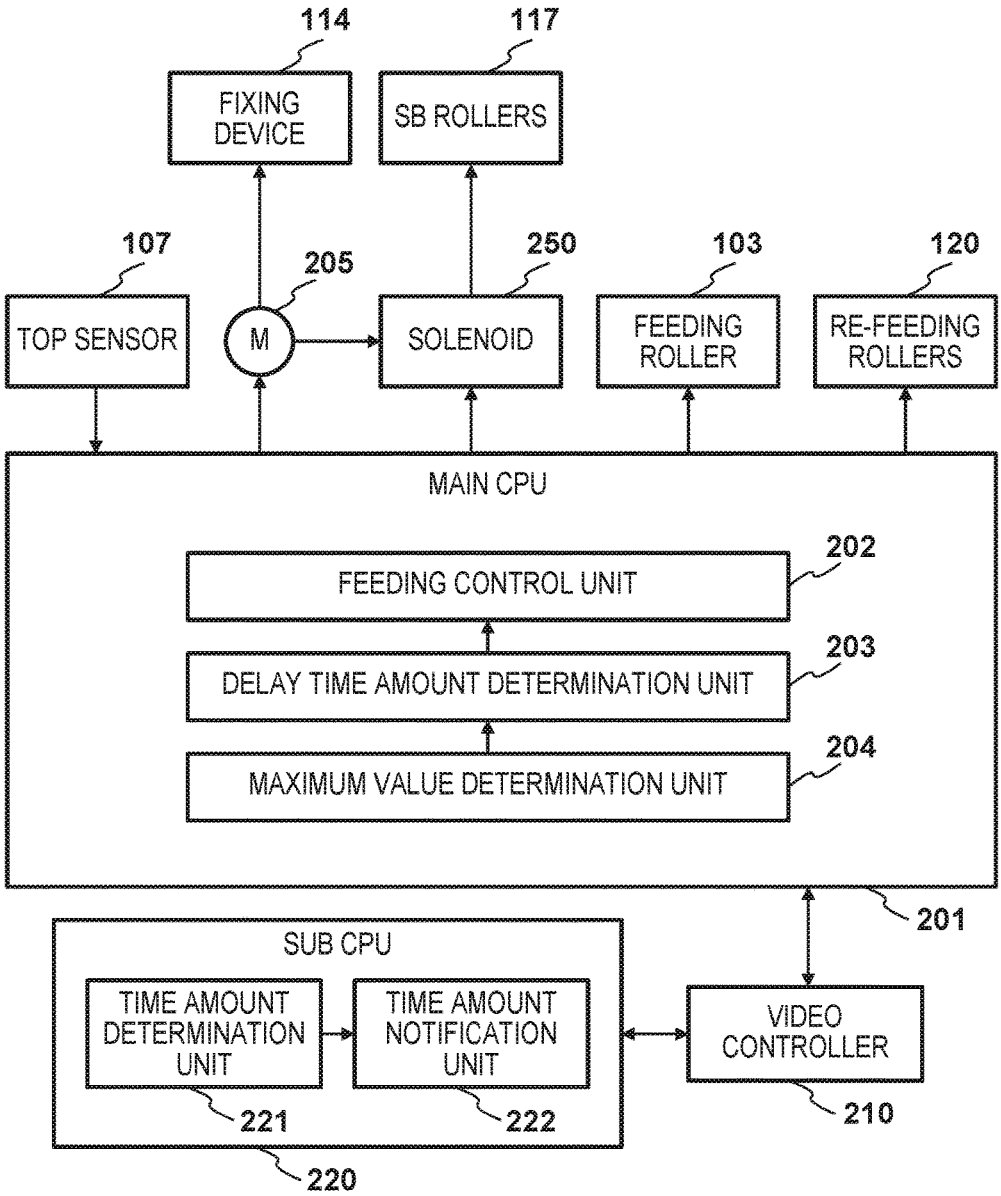
FIG. 2 is a diagram of control blocks in an image forming system.

FIG. 2 is block diagram showing a control system. A main CPU 201 is a control unit that controls image formation in the image forming apparatus 101 and sheet conveyance. A sub CPU 220 that controls operations of the post-processing apparatus 130 is provided in the post-processing apparatus 130. The main CPU 201 and the sub CPU 220 each internally include an arithmetic circuit, a ROM, a RAM, and the like, and execute various types of control based on a program stored in the ROM in advance. A portion or all of the functions realized by the main CPU 201 and the sub CPU 220 may be realized using hardware or may be realized using software.

The top sensor 107 is connected to the main CPU 201. The main CPU 201 determines the timing of various types of control (feed timing, timing of laser light writing, etc.) using a detection signal output by the top sensor 107 as a reference. A video controller 210 generates print conditions, a print instruction, and image data and transmits them to the main CPU 201. The video controller 210 outputs image data using, as a reference, the time at which the top sensor 107 detected the leading edge of the sheet S. Accordingly, the toner image is transferred to a desired position on the sheet S. To the sub CPU 220, the video controller 210 transmits loading notifications, post-processing conditions, and the like of the sheets S to be conveyed to the post-processing apparatus 130. In accordance with the loading notification, the sub CPU 220 controls the nipping/separation of the discharge roller 136 and controls the position of the jogger 137. Also, the sub CPU 220 executes post-processing such as stapling in accordance with the post-processing conditions (number of sheets constituting the bundle, binding position, etc.). A time amount determination unit 221 of the sub CPU 220 determines the post-processing time amount using an equation, a table, or the like, based on the post-processing conditions. The time amount notification unit 222 of the sub CPU 220 notifies the main CPU 201 of the post-processing time amount via the video controller 210. A delay time amount determination unit 203 of the main CPU 201 and the feeding control unit 202 adjust the feed times for the sheet cassette 102 according to the post-processing time amount so that a sheet S fed from the sheet cassette 102 and a sheet S waiting on the sub conveyance path 142 do not contact. A maximum value determination unit 204 determines the maximum value of the number of sheets that can wait on the sub conveyance path 142 (maximum wait number W). According to the maximum wait number W, the feeding control unit 202 and the delay time amount determination unit 203 adjust the sequence in which sheets S are fed to the image forming unit 113, the delay time amount Text of the feed timing, and the like. The delay time amount determination unit 203 and the maximum value determination unit 204 may be included in the feeding control unit 202. The delay time amount determination unit 203 may have a determination function of determining whether or not delaying of the feed time is necessary according to the post-processing time amount notified from the sub CPU 220. A motor 205 is a driving source that drives the SB rollers 117 and the fixing device 114. In other words, the SB rollers 117 and the fixing device 114 are driven by the same driving source.

The configuration for driving the SB rollers 117 and the fixing device 114 will be described next in detail. A solenoid 250 that switches the rotation direction of the SB rollers 117 is provided between the motor 205 and the SB rollers 117, but a clutch for switching transmission of the driving power from the motor 205 to the SB rollers 117 is omitted. If the fixing device 114 is stopped while printing is being performed, a lot of time is needed to restore it, and therefore, as a fundamental rule, the CPU 201 does not stop the motor 205 during printing. In other words, the SB rollers 117 continuously rotate in the direction of pulling sheets S onto the reverse conveyance path 145 or in the direction of pulling sheets S off of the reverse conveyance path 145. Therefore, in a state where the SB rollers 117 are stopped and the SB rollers 117 nip the sheets S, the sheet S cannot be allowed to wait on the reverse conveyance path 145.

Also, as a configuration in which the rotation direction of the SB rollers 117 is switched by the solenoid 250, a configuration is conceivable in which two gear driving columns are arranged between the motor 205 and the SB rollers 117, for example. If the motor 205 is engaged with a first gear driving column, the SB rollers 117 rotate in a direction of pulling the sheets S onto the reverse conveyance path 145. On the other hand, if the motor 205 is engaged with a second gear driving column, the SB rollers 117 rotate in a direction of pulling the sheets S off of the reverse conveyance path 145. Also, the main CPU 201 uses the solenoid 250 to switch from a state in which the motor 205 is engaged with one of the gear driving columns, to a state in which the motor 205 is engaged with the other one of the gear driving columns.

In FIG. 2, the motor that drives the feeding roller 103 is shown as being integral with the feeding roller 103. The motor that drives the re-feeding rollers 120 is shown as being integral with the re-feeding rollers 120.

Conveyance Control

Figure 3A:
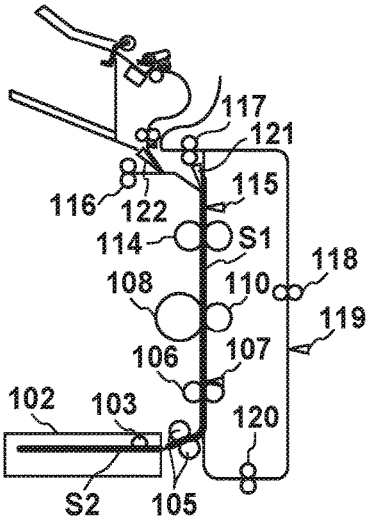
FIGS. 3A to 3F are diagrams showing sheet conveyance during double-sided continuous printing.
Figure 3B:
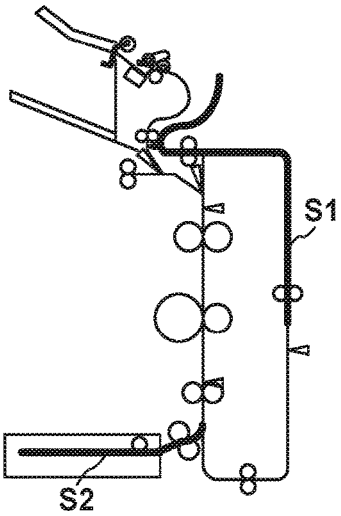
Figure 3C:
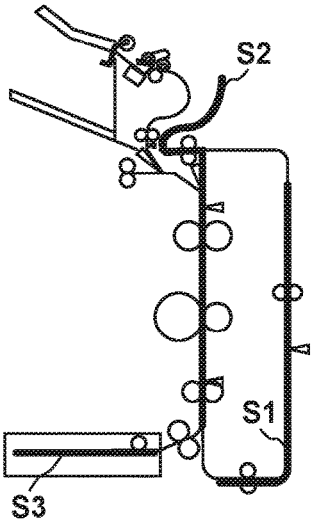

FIGS. 3A to 3F show a method for conveying sheets S when double-sided printing is instructed. FIG. 3A shows a state in which a first sheet S1 has been fed by the feeding rollers 103, conveyed by the FR rollers 105 and the conveyance rollers 106, and an image has been formed on a first surface by the image forming unit 113. FIG. 3B shows a state in which, due to the SB rollers 117 reversing, the sheet S1 is guided to the sub conveyance path 142 and conveyed by the conveyance rollers 118. The feeding control unit 202 drives the feeding roller 103 and feeds a second sheet S2. FIG. 3C shows a state in which the feeding control unit 202 has stopped the conveyance rollers 118 and the re-feeding rollers 120 using, as a reference, the time at which the leading edge of the sheet S1 was detected by the sheet sensor 119. That is, the feeding control unit 202 causes the sheet S1 to wait here until a time at which image forming can be performed on the second surface of the sheet S1. While the sheet S1 is waiting, the feeding control unit 202 controls the SB rollers 117 and conveys the sheet S2 to the reversal position. If no printing instruction comes from the video controller 210, the sheet S2 will end up reaching the reversal position before printing can be performed on the sheet S1. The SB rollers 117 are driven by the motor 205, which is the same driving source as the fixing device 114, and thus the SB rollers 117 cannot be stopped. Accordingly, it is not possible to allow the sheet to wait on the reverse conveyance path 145. For this reason, the feeding control unit 202 may automatically discharge the waiting sheet S1 and the sheet S2 that has reached the reversal position as misprints.

Figure 3D:
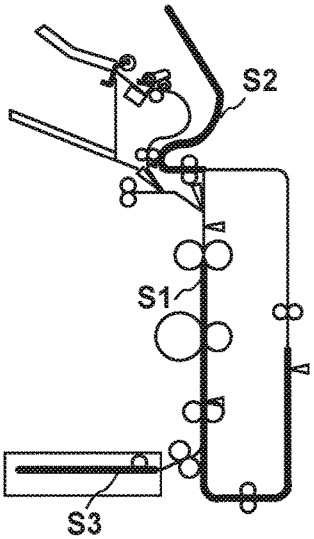
Figure 3E:
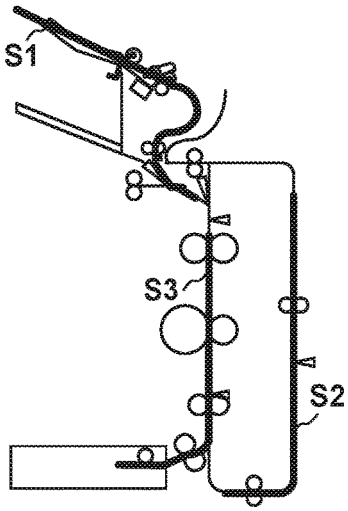
Figure 3F:
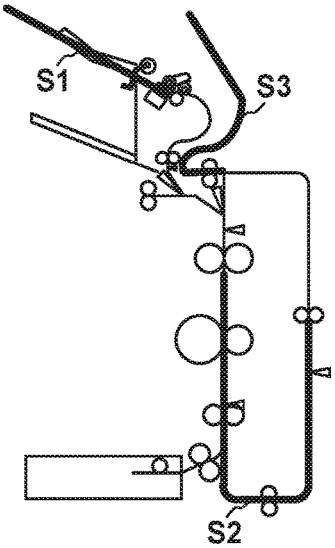

FIG. 3D shows a state in which in order to form an image on the second surface of the sheet S1, the conveyance rollers 118 and the re-feeding rollers 120 are driven, whereby the conveyance of the sheet S1 is resumed, and the image forming unit 113 forms an image. When the trailing edge of the sheet S2 reaches the reversal position, the feeding control unit 202 reverses the rotation direction of the SB rollers 117 and guides the sheet S2 to the sub conveyance path 142. FIG. 3E shows a state in which after image formation on the second surface is complete, the sheet S1 is discharged to the post-processing apparatus 130. The sheet S2 waits on the sub conveyance path 142. A third sheet S3 is fed from the sheet cassette 102, and an image is formed on a first surface thereof. FIG. 3F shows a state in which the sheet S3 is being conveyed toward the sub conveyance path 142. The sheet S2 is being re-fed, and an image is being formed on the second surface thereof by the image forming unit 113. Thereafter, double-sided continuous printing is executed in which the feeding of a sheet $S_{i+1}$ from the sheet cassette 102 to the image forming unit 113 and the re-feeding of a sheet $S_i$ from the sub conveyance path 142 to the image forming unit 113 are alternatingly executed. i indicates the order of being fed from the sheet cassette 102.

Maximum Wait Number

Figure 4:
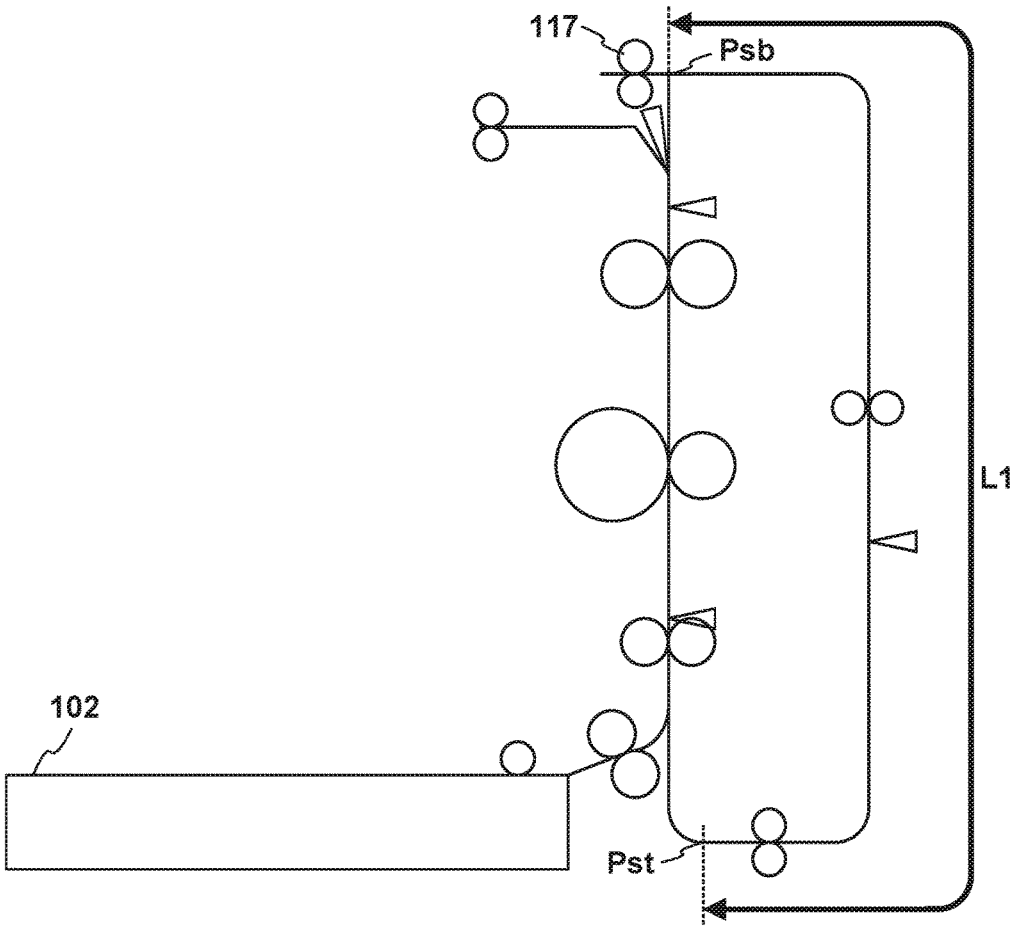
FIG. 4 is a diagram showing a method for determining a maximum wait number.

As described above, the conveyance path length of the sub conveyance path 142 is limited, and therefore there is an upper limit (maximum value) to the number of sheets S that can wait on the sub conveyance path 142. This can be referred to as the maximum wait number W. FIG. 4 is a diagram illustrating a method for determining the maximum wait number W. The maximum wait number W depends on the length of the sheets S in the conveyance direction (sheet length Lpap). The maximum wait number W also depends on the conveyance path length L1 from the reversal position Psb to the wait position Pst on the sub conveyance path 142. The maximum value determination unit 204 determines a quotient obtained by dividing the conveyance path length L1 by the sheet length Lpap as the maximum wait number W. Note that the number of sheets S that can wait on the sub conveyance path 142 depends on the configuration of the image forming apparatus 101. For example, because the driving source is shared by multiple rollers, the SB rollers 117 can be switched between forward rolling and reverse rolling but cannot be stopped. Also, in this kind of case, the maximum wait number W is sometimes restricted to 1. Also, in the case where the sheet length Lpap exceeds the conveyance path length L1, the maximum wait number W may be restricted to 0. This is done to prevent multiple sheets S from colliding on the sub conveyance path 142.

Sheet Interval

Figures 5A, 5B:
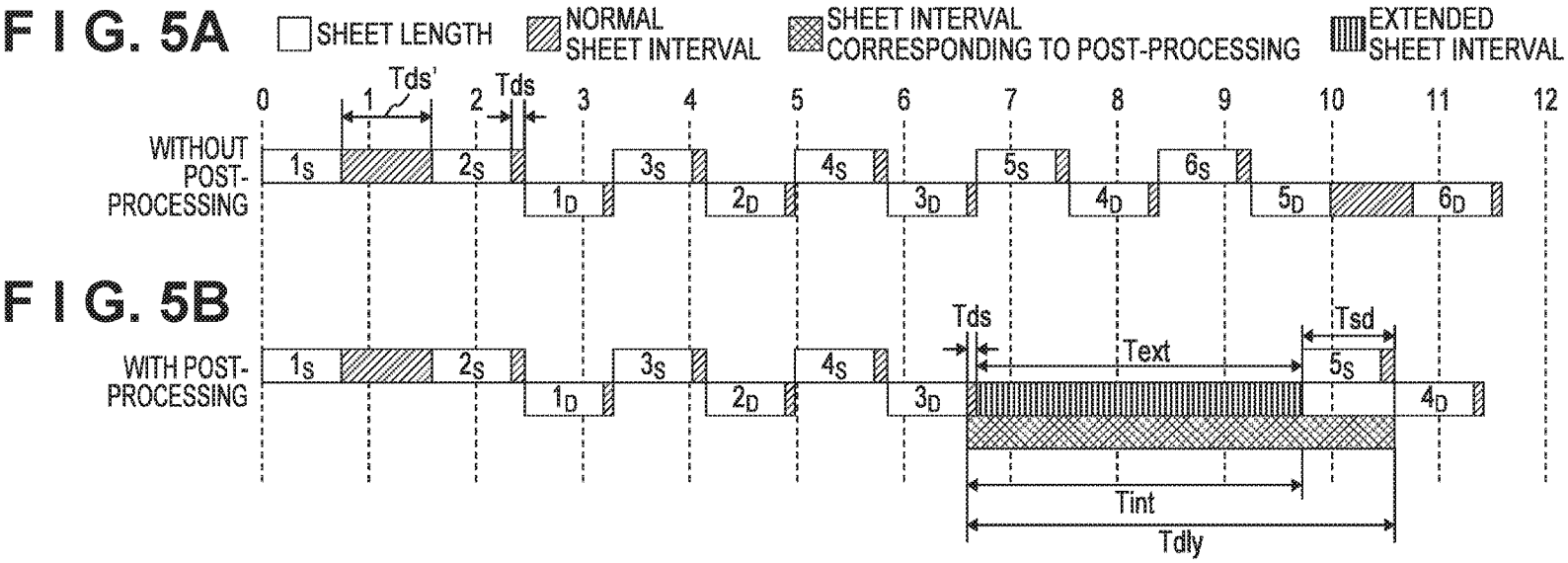
FIGS. 5A and 5B are diagrams showing control for delaying a feed time.

FIGS. 5A and 5B are diagrams that illustrate the influence that a post-processing time amount Tdly has on a sheet interval. Here, the maximum wait number W is assumed to be 1. FIG. 5A shows sheet intervals when there is no post-processing. FIG. 5B shows sheet intervals when post-processing is executed. The numbers 0 to 12 included in FIGS. 5A and 5B indicate elapsed time (in seconds). Here, 0 seconds corresponds to a time at which the top sensor 107 detects the leading edge of the first sheet S.

The first surface (hereinafter denoted as "$1_S$") of the first sheet S1 is first conveyed to the image forming unit 113, and the first surface (hereinafter denoted as "$2_S$") of the second sheet S2 is subsequently conveyed to the image forming unit 113. Because the maximum wait number W is 1, the second surface (hereinafter denoted as "$1_D$") of the first sheet S1 is conveyed to the image forming unit 113. Thereafter, the first surface $i_S$ of the i-th sheet $S_i$, the second surface $(i-1)_D$ of the (i−1)-th sheet $S_{i-1}$, and the first surface $(i+1)_S$ of the (i+1)-th sheet $S_{i+1}$ are conveyed in the stated order to the image forming unit 113 (i≥3).

Note that in FIGS. 5A and 5B, a sheet interval Tds' from the trailing edge of the first surface $\mathbf{1}_S$ of the first sheet to the leading edge of the first surface $\mathbf{2}_S$ of the second sheet and a sheet interval Tds from the trailing edge of the first surface $\mathbf{2}_S$ of the second sheet to the leading edge of the second surface $\mathbf{1}_D$ of the first sheet are different. The purpose of this is to avoid a case in which the first surface $\mathbf{1}_S$ of the first sheet and the first surface $\mathbf{2}_S$ of the second sheet contact due to the first surface $\mathbf{1}_S$ of the first sheet and the first surface $\mathbf{2}_S$ of the second sheet being guided to the sub conveyance path 142 together. In other words, if the sheet interval is too small, the first surface $\mathbf{2}_S$ of the second sheet will come close during the reversal of the first surface $\mathbf{1}_S$ of the first sheet, and the first surface $\mathbf{2}_S$ of the second sheet will contact with the first surface $\mathbf{1}_S$ of the first sheet. Accordingly, the first surface $\mathbf{2}_S$ of the second sheet is fed delayed by the amount of time needed for the reversal of the first surface $\mathbf{1}_S$ of the first sheet. In contrast, when the image is formed, the second surface $\mathbf{1}_D$ of the first sheet is guided to the discharge conveyance path 143, and therefore the sheet interval between the first surface $\mathbf{2}_S$ of the second sheet and the second surface $\mathbf{1}_D$ of the first sheet can be relatively shortened. For similar reasons, the sheet interval between the second surface $\mathbf{1}_D$ of the first sheet and the first surface $\mathbf{3}_S$ of the third sheet can also be shortened. The normal sheet interval Tds is commonly set to the minimum sheet interval of the image forming apparatus 101 in order to maximize the number of sheets on which image formation is performed per unit time. The minimum sheet interval is the smallest sheet interval that can be detected by the top sensor 107 or the sheet sensor 119.

The post-processing shown in FIG. 5B is post-processing for forming one bundle (sheet group) with three sheets S and executing stapling. The post-processing time amount is four seconds. In other words, a first sheet group (first bundle) is formed with sheet S1 to sheet S3, and a second sheet group (second bundle) is formed with sheet S4 to sheet S6. When the second surface $\mathbf{3}_D$ of the final sheet forming the first bundle passes the image forming unit 113, the first surface $\mathbf{4}_S$ of the leading sheet forming the second bundle is already on the sub conveyance path 142. In other words, the number of sheets S actually waiting on the sub conveyance path 142 has reached the maximum wait number W. In this case, if the first surface $\mathbf{5}_S$ of the fifth sheet is conveyed to the image forming unit 113, it will not be possible to ensure the sheet interval corresponding to the amount of post-processing time (four seconds) between the second surface $\mathbf{4}_D$ of the fourth sheet and the second surface $\mathbf{3}_D$ of the third sheet. Alternatively, the first surface $\mathbf{5}_S$ of the fifth sheet will contact with the trailing edge of the fourth sheet waiting on the sub conveyance path 142. The reason why is because the fifth sheet S cannot wait on the reverse conveyance path 145 when the SB rollers 117 are stopped and the SB rollers 117 nip the fifth sheet S. If the sheet S4 for forming the next bundle enters the post-processing apparatus 130 before the post-processing for the sheet S1 to the sheet S3 is complete, the post-processing will fail. Accordingly, a sheet interval corresponding to the post-processing time amount is needed as the sheet interval between the second surface $\mathbf{3}_D$ of the third sheet and the second surface $\mathbf{4}_D$ of the fourth sheet. In view of this, in the present embodiment, the feed time of the first surface $5_S$ of the fifth sheet is delayed, whereby the sheet interval between the second surface $3_D$ of the third sheet and the second surface $4_D$ of the fourth sheet in the post-processing apparatus 130 is sufficiently ensured. In other words, the feed time of the first surface $5_S$ of the fifth sheet is adjusted in order to set the sheet interval between the second surface $3_D$ of the third sheet and the second surface $4_D$ of the fourth sheet to a sheet interval that corresponds to the post-processing time amount. As shown in FIG. 5B, the sheet interval Tint between the second surface $3_D$ of the third sheet and the first surface $5_S$ of the fifth sheet is expressed using the following equation.

$$Tint=Tdly-Tsd \quad \text{Eq. 1}$$

Here, Tdly is the post-processing time amount notified from the post-processing apparatus 130. Tsd is the amount of time from the feed time of the first surface $5_S$ of the fifth sheet to the re-feed time of the second surface $4_D$ of the fourth sheet.

Letting Tds be the normal sheet interval between the second surface $3_D$ of the third sheet and the first surface $5_S$ of the fifth sheet in the case of having no post-processing, the delay time amount Text corresponding to the extended sheet interval is indicated by equation Eq. 2.

$$Text=Tint-Tds \quad \text{Eq. 2}$$

As indicated by equation Eq. 2, the feed time of the first surface $5_S$ of the fifth sheet is delayed by the delay time amount Text relative to the normal sheet interval Tds. Accordingly, the sheet interval between the second surface $3_D$ of the third sheet and the second surface $4_D$ of the fourth sheet is maintained at a sheet interval corresponding to the post-processing time amount Tdly. In other words, even if the sheet interval between the second surface $3_D$ of the third sheet and the second surface $4_D$ of the fourth sheet is maintained at a sheet interval corresponding to the post-processing time amount Tdly, the feed time of the first surface $5_S$ of the fifth sheet is also delayed so that the first surface $5_S$ of the fifth sheet does not contact with the second surface $4_D$ of the fourth sheet on the sub conveyance path 142.

Note that in FIG. 5B, in order to set the sheet interval between the second surface $3_D$ of the third sheet and the second surface $4_D$ of the fourth sheet to a sheet interval corresponding to the post-processing time amount Tdly, the time interval from when the second surface $3_D$ of the third sheet is fed to when the first surface $5_S$ of the fifth sheet is fed is made longer. On the other hand, the time interval from when the first surface $5_S$ of the fifth sheet is fed to when the second surface $4_D$ of the fourth sheet is fed does not change relative to the normal time interval shown in FIG. 5A. However, the present invention is not limited to this control.

For example, the time interval from when the first surface $5_S$ of the fifth sheet is fed to when the second surface $4_D$ of the fourth sheet is fed may be changed relative to the normal time interval shown in FIG. 5A. However, if the time interval is made shorter, the conveyance is controlled such that the post-processing time amount Tdly is ensured, and if the time interval is made longer, the conveyance is controlled such that the fifth sheet does not contact with the waiting fourth sheet.

Flowchart

Figure 6:
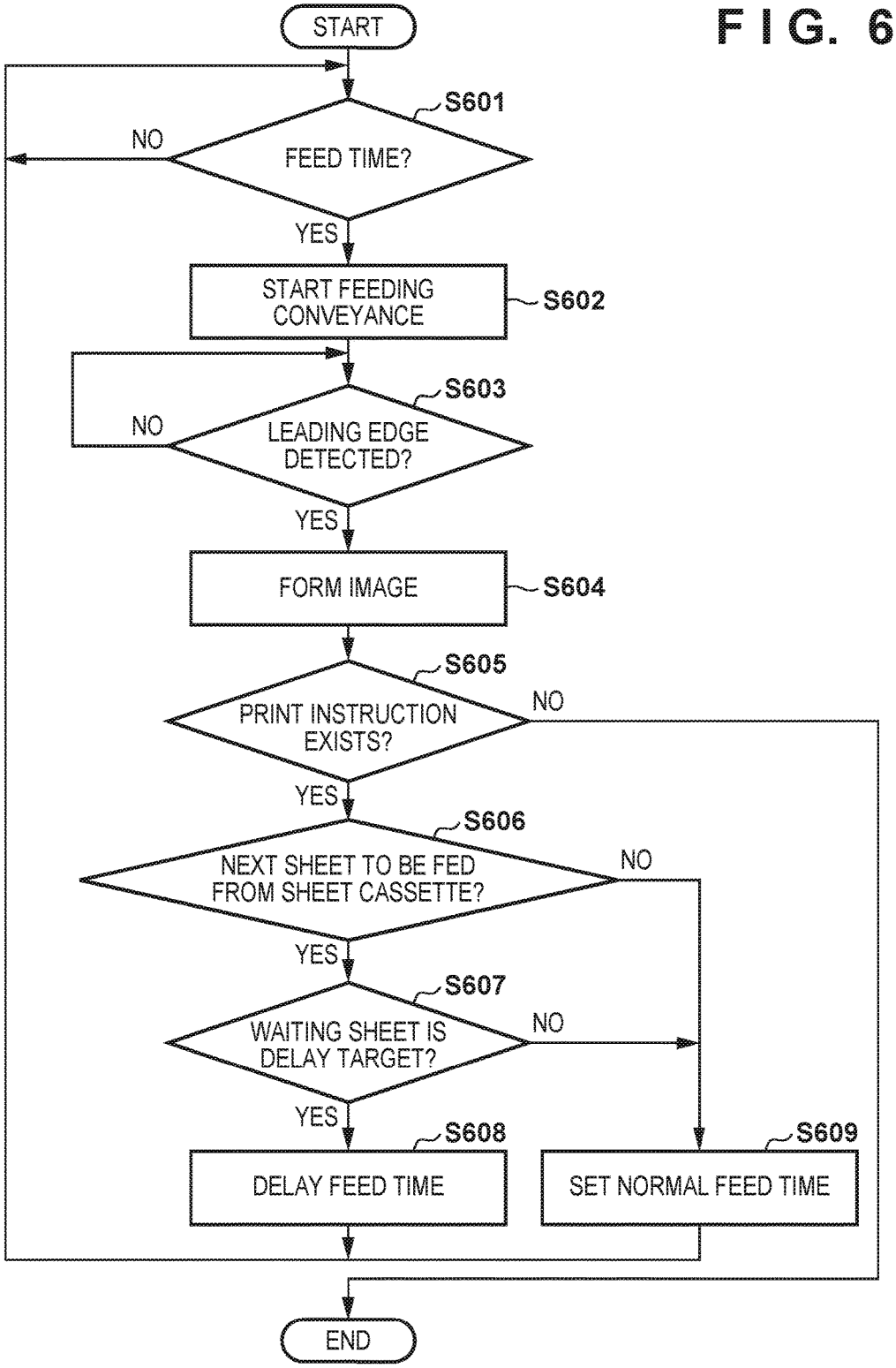
FIG. 6 is a flowchart showing control for delaying a feed time.

FIG. 6 is a flowchart showing feeding control. Upon receiving a printing instruction from the video controller 210, the main CPU 201 executes the following processes. Note that it is presupposed that an instruction was given to perform post-processing on N sheets S subjected to double-sided printing in a print job. Also, the maximum wait number W on the sub conveyance path 142 is 1. Note that analysis of the print job may be executed by the video controller 210. In such a case, the main CPU 201 or the sub CPU 220 executes the following control according to the analysis results acquired by the video controller 210.

In step S601, the main CPU 201 waits for the feed time by determining whether or not the feed time has arrived. The feed time of the first sheet S in the print job for forming images on multiple sheets S is the time when preparation for a feeding operation is completed by the image forming apparatus 101. The times for the second sheet S and onward are set as described below. For example, when the leading edge of the first sheet S is detected by the top sensor 107, the feeding control unit 202 of the main CPU 201 causes a counter to start counting. When the count value of the counter reaches a value set as the feed time, the feeding control unit 202 determines that the feed time has arrived. When the feed time arrives, the main CPU 201 moves to step S602.

In step S602, the main CPU 201 (feeding control unit 202) causes the driving source of the feeding roller 103 to operate, thereby causing the feeding roller 103 to rotate. Thus, the sheets S are conveyed from the sheet cassette 102 to the main conveyance path 141. In step S603, the main CPU 201 (feeding control unit 202) determines whether or not the top sensor 107 has detected the leading edge of the sheet S based on a detection signal output from the top sensor 107. When the leading edge of the sheet S reaches the top sensor 107, the main CPU 201 moves to step S604.

In step S604, the main CPU 201 controls the image forming unit 113 to execute image formation. For example, the main CPU 201 outputs a top signal for starting output of the image signal to the video controller 210. Accordingly, the video controller 210 outputs the image signal to the main CPU 201. The main CPU 201 drives the exposure device 112 according to the image signal and thus forms an electrostatic latent image on the photosensitive drum 108. The electrostatic latent image is developed, and the toner image is furthermore transferred onto the sheet S. Also, the toner image is fixed to the sheet S by the fixing device 114. The feeding control unit 202 controls the flappers 121 and 122 and guides the sheets S in accordance with the print job. For example, the feeding control unit 202 controls the flappers 121 and 122 by driving a drive source such as a solenoid.

In step S605, the main CPU 201 analyzes the print job to determine whether or not a print instruction still remains. If the analysis of the print job is executed by the video controller 210, the main CPU 201 determines whether or not a print instruction received from the video controller 210 remains. If no print instruction remains, the main CPU 201 ends the printing operation according to the present flowchart. On the other hand, if a print instruction remains, the main CPU 201 moves to step S606.

In step S606, the main CPU 201 analyzes the print job to determine whether or not the sheet S that is to be fed next to the image forming unit 113 is to be fed from the sheet cassette 102. Alternatively, the main CPU 201 may determine whether or not the surface on which an image is to be formed next by the image forming unit 113 is a first surface. If the analysis of the print job is executed by the video controller 210, the main CPU 201 may execute this determination by analyzing a command received from the video controller 210. If the next sheet to be fed is a sheet S to be fed from the sheet cassette 102, the main CPU 201 moves to step S607. If the next sheet to be fed is not a sheet S to be fed from the sheet cassette 102, or in other words, if it is a sheet S that is to be re-fed from the sub conveyance path 142, the main CPU 201 moves to step S609. In step S609, the feeding control unit 202 sets the feed time of the sheet S to be re-fed from the sub conveyance path 142 such that the sheet interval for the sheet S fed from the sheet cassette 102 is the normal sheet interval Tds.

In step S607, the main CPU 201 (delay time amount determination unit 203) analyzes the print job to determine whether or not the sheet S waiting on the sub conveyance path 142 is a delay target. A delay target is a sheet whose conveyance to the post-processing apparatus 130 is to be delayed until post-processing performed on another sheet in the post-processing apparatus 130 is complete. For example, the delay time amount determination unit 203 determines whether or not the sheet S (successive sheet) to be fed to the image forming unit 113 subsequent to the sheet S to be fed to the image forming unit 113 is a delay target. For example, if the post-processing time amount Tdly notified from the sub CPU 220 exceeds a threshold value, the delay time amount determination unit 203 determines that the sheet S (first sheet S of the next bundle) waiting on the sub conveyance path 142 is a sheet S that is a delay target. The threshold value is, for example, the sum of Tsd and Tds shown in FIG. 5B. As can be understood from FIG. 5A, Tsd and Tds correspond to the sheet interval between the third sheet (second surface $\mathbf{3}_D$) and the fourth sheet (second surface $\mathbf{4}_D$) waiting on the sub conveyance path 142 in continuous image formation, for example. If the post-processing time amount Tdly is less than or equal to the sum of Tsd and Tds, the post-processing of the third sheet will be complete before the fourth sheet enters the post-processing apparatus 130. Accordingly, the sum of Tsd and Tds can be used as a threshold value for determining whether or not extension is to be performed. Alternatively, if the sheet S waiting at the front of the sub conveyance path 142 is the first sheet of a sheet group, the delay time amount determination unit 203 may determine that the sheet S waiting at the front is a delay target. Also, if the maximum wait number W is 1, the sheet S to be fed to the image forming unit 113 before the sheet S that is the delay target is a sheet S whose feed time is to be delayed according to the post-processing time amount Tdly. If the next waiting sheet is not to a delay target, the main CPU 201 moves to step S609.

In step S609, the main CPU 201 (delay time amount determination unit 203) sets the normal feed time as the feed time of the sheet S to be fed to the image forming unit 113. The normal feed time is a feed time at which the sheet interval between a preceding sheet S and a successive sheet S at a time of passing a detection position of the top sensor 107 is the normal sheet interval Tds. On the other hand, if the waiting sheet is a delay target, the main CPU 201 moves to step S608.

In step S608, the main CPU 201 (delay time amount determination unit 203) delays the feed time of the sheet S to be fed from the sheet cassette 102 relative to the normal feed time by a delay time amount Text that corresponds to the post-processing time amount Tdly. In other words, the delay time amount determination unit 203 calculates the delay time amount Text and sets it for the feeding control unit 202. The delay time amount Text can be calculated by, for example, multiplying the number of sheets by a coefficient, or multiplying the number of binding positions by a coefficient. The feeding control unit 202 determines the time after the elapse of the delay time amount Text from the normal feed timing to be the new feed time. Thus, if the re-feeding of the sheet to be fed next from the sub conveyance path 142 (second surface $\mathbf{4}_D$ of the fourth sheet shown in FIG. 5B) is to be postponed according to the post-processing time amount Tdly, the feed time of the sheet S to be fed from the sheet cassette 102 (first surface $\mathbf{5}_S$ of the sheet in FIG. 5B) is subjected to a delay setting. Thereafter, the main CPU 201 (feeding control unit 202) returns to step S601 and waits for the feed time set in step S608 or step S609.

Accordingly, the leading edge of the sheet (e.g., the first surface $\mathbf{5}_S$ of the fifth sheet) to be fed from the sheet cassette 102 is prevented from colliding with the trailing edge of the sheet (e.g., the second surface $\mathbf{4}_D$ of the fourth sheet) waiting on the sub conveyance path 142. For example, the feed time of the sheet S (e.g., $\mathbf{5}_S$) to be fed from the sheet cassette 102 is set such that the leading edge of the sheet S (e.g., $\mathbf{5}_S$) fed from the sheet cassette 102 reaches the top sensor 107 at a time delayed by Tint relative to the time at which the trailing edge of the final sheet (e.g., $\mathbf{3}_D$) of the bundle was detected by the top sensor 107. Note that if the time at which the leading edge of the final sheet (e.g., $\mathbf{3}_D$) of the bundle reaches the top sensor 107 is used as a reference, the feed time of the sheet S (e.g., $\mathbf{5}_S$) to be fed from the sheet cassette 102 is determined using the following equation. In other words, the sheet S (e.g., $\mathbf{5}_S$) is fed from the sheet cassette 102 when a time amount tf1 has elapsed since the time at which the leading edge of the final sheet (e.g., $\mathbf{3}_D$) of the bundle reaches the top sensor 107.

$$tf1 = Lp/V + Tint - Lz1/V \quad \text{Eq. 3}$$

Here, Lp is the sheet length in the conveyance direction of the final sheet (e.g., $\mathbf{3}_D$) of the bundle. V is the conveyance velocity of the sheet. Lz1 is the distance from the sheet cassette 102 to the detection position of the top sensor 107. Also, the feed time of a delay target sheet (e.g., $\mathbf{4}_D$) for which discharging to the post-processing apparatus 130 is to be delayed (postponed) is set using, as a reference, the time at which the leading edge of the sheet (e.g., $\mathbf{5}_S$) to be fed from the sheet cassette 102 reaches the top sensor 107. In other words, upon the elapse of a time amount tf2 after that time, the feeding control unit 202 re-feeds the delay target sheet (e.g., $\mathbf{4}_D$) from the sub conveyance path 142.

$$tf2 = Tsd - Lz2/V \quad \text{Eq. 4}$$

Here, Lz2 is the distance from the double-sided waiting position Pst to the detection position of the top sensor 107. In other words, the delay target sheet (e.g., $\mathbf{4}_D$) is re-fed from the sub conveyance path 142 upon the elapse of the time amount tf2 after the time at which the leading edge of the sheet (e.g., $\mathbf{5}_S$) to be fed from the sheet cassette 102 reached the top sensor 107. Accordingly, the sheet interval between the sheet (e.g., $\mathbf{5}_S$) to be fed from the sheet cassette 102 and the delay target sheet (e.g., $\mathbf{4}_D$) to be fed from the sub conveyance path 142 is maintained at Tds.

According to the present invention, the leading edge of the sheet (e.g., first surface $\mathbf{5}_S$ of the sheet) fed from the sheet cassette 102 is prevented from colliding with the trailing edge of the sheet (e.g., the second surface $\mathbf{4}_D$ of the sheet) waiting on the sub conveyance path 142. Conventionally, if the first surface $\mathbf{5}_S$ of the sheet and the second surface $\mathbf{4}_D$ of the sheet were about to contact, these sheets were mandatorily discharged as a misprint. However, the image forming apparatus 101 of the present embodiment adjusts the feed times thereof, and thus misprints are reduced and printing is continued. Accordingly, an image forming apparatus in which multiple sheets are not likely to contact is provided. Also, because misprints are reduced, the productivity of the image forming apparatus 101 is improved.

The present embodiment illustrated a case in which the maximum wait number W was 1. However, the maximum wait number W may be 2 or more. In that case as well, if the first sheet S waiting on the sub conveyance path 142 is the first sheet of the bundle to be formed in the post-processing apparatus 130, the feed time of the sheet S to be fed from the sheet cassette 102 is delayed. Accordingly, the sheet S to be fed from the sheet cassette 102 is prevented from colliding with the final sheet S waiting on the sub conveyance path 142.

Case where the Maximum Wait Number is 0

Figures 7A, 7B:
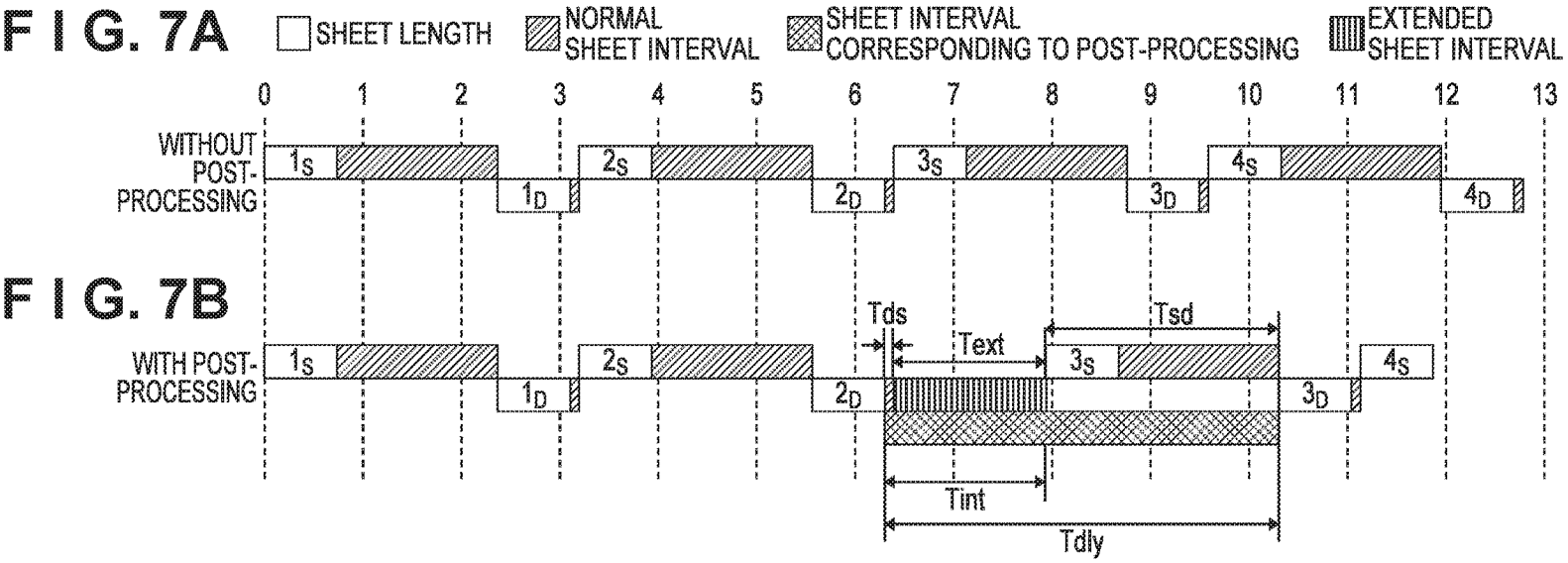
FIGS. 7A and 7B are diagrams showing control for delaying a feed time.

FIGS. 7A and 7B illustrate a case in which the maximum wait number W is 0. In particular, FIG. 7A shows the conveyance status of multiple sheets S in a case where there is no post-processing. Because the maximum wait number W is 0, the sheet conveyance sequence is as follows: first surface $\mathbf{1}_S$ of the first sheet, second surface $\mathbf{1}_D$ of the first sheet, first surface $\mathbf{2}_S$ of the second sheet, second surface $\mathbf{2}_D$ of the second sheet, . . . , first surface $i_S$ of the i-th sheet, second surface $i_D$ of the i-th sheet. FIG. 7B shows a case in which post-processing for forming one bundle using two sheets S is executed. The post-processing time amount Tdly is four seconds. In order to avoid a collision between the second surface $\mathbf{2}_D$ of the final sheet forming the bundle and the second surface $\mathbf{3}_D$ of the first sheet forming the next bundle, a four-second sheet interval is needed as the sheet interval between the second surface $\mathbf{2}_D$ and the second surface $\mathbf{3}_D$. However, because the maximum wait number W is 0, the second surface $\mathbf{3}_D$ cannot be allowed to wait on the sub conveyance path 142. In view of this, as shown in FIG. 7B, the feeding control unit 202 delays the feeding of the first surface $\mathbf{3}_S$, which is the surface on the opposite side of the second surface $\mathbf{3}_D$. Accordingly, the sheet interval between the second surface $\mathbf{2}_D$ of the second sheet and the second surface $\mathbf{3}_D$ of the third sheet is expanded according to the post-processing time amount Tdly. The delay time amount Text relative to the normal feed time is obtained using equation Eq. 1 and equation Eq. 2. That is, the feeding control unit 202 delays the time of feeding the third sheet from the sheet cassette 102 by the delay time amount Text relative to the normal feed time. The delay time amount Text is determined by the delay time amount determination unit 203 and is set for the feeding control unit 202. Accordingly, the sheet interval between the second surface $\mathbf{2}_D$ of the second sheet and the second surface $\mathbf{3}_D$ of the third sheet can be made to coincide with the post-processing time amount Tdly. Thus, according to the present embodiment, even if the maximum wait number W is 0, misprints for avoiding sheet collisions are reduced. In other words, even if there is post-processing, printing can be continued, and a reduction in productivity is suppressed.

Note that in FIG. 7B, in order to set the sheet interval between the second surface $\mathbf{2}_D$ of the second sheet and the second surface $\mathbf{3}_D$ of the third sheet to a sheet interval corresponding to the post-processing time amount Tdly, the time interval from when the second surface $\mathbf{2}_D$ of the second sheet is fed to when the first surface $\mathbf{3}_S$ of the third sheet is fed is made longer. On the other hand, the time interval from when the first surface $\mathbf{3}_S$ of the third sheet is fed to when the second surface $\mathbf{3}_D$ of the third sheet is fed does not change relative to the normal time interval shown in FIG. 7A. However, the present invention is not limited to this control.

For example, the time interval from when the first surface $\mathbf{3}_S$ of the third sheet is fed to when the second surface $\mathbf{3}_D$ of the third sheet is fed may change relative to the normal time interval shown in FIG. 7A. However, if the time interval is made shorter, the conveyance is controlled such that the post-processing time amount Tdly is ensured, and if the time interval is made longer, the conveyance is controlled such that the fourth sheet does not contact with the waiting third sheet.

SUMMARY

As was described with reference to FIG. 1 and the like, the feeding roller 103, sheet cassette 102, and the like are an example of a first feeding unit according to which a sheet with no image yet formed on both the first surface or second surface thereof is fed to the image forming unit 113. The re-feeding roller 120 and the like are an example of a second feeding unit according to which a sheet with an image formed on the first surface thereof is fed to the image forming unit 113. The main CPU 201, the feeding control unit 202, and the like are an example of a feeding control unit that controls the feeding roller 103 and the re-feeding rollers 120. The image forming unit 113, the light exposure device 112, the fixing device 114, and the like are an example of an image forming unit that forms images on the first surface of a sheet fed by the feeding roller 103 and on the second surface of a sheet fed by the re-feeding rollers 120. Note that depending on the print job, there may be a surface on which no image is formed. The post-processing apparatus 130 is an example of a post-processing unit that applies post-processing to a sheet. Also, the post-processing apparatus 130 is an example of a post-processing unit that applies post-processing to a sheet group composed of multiple sheets with images formed on both the first surfaces and second surfaces thereof. Note that the post-processing apparatus 130 may apply post-processing to sheets S that have passed through the image forming unit 113 without being subjected to image formation. The sub CPU 220 is an example of a post-processing control unit that controls the post-processing. As described with reference to FIG. 5B and the like, the feed time of the sheet fed by the feeding roller 103 is adjusted such that the sheet fed from the sheet cassette 102 does not contact with the sheet waiting on the sub conveyance path 142. The main CPU 201 executes adjustment of the feed time based on the post-processing time amount Tdly notified from the sub CPU 220. In other words, the main CPU 201 adjusts the feed time of the another sheet to be fed by the feeding roller 103 based on the post-processing time amount Tdly of a first sheet group notified from the sub CPU 220. Accordingly, the feed time is adjusted such that the other sheet does not contact with a sheet that is to form a second sheet group to be subjected to post-processing after the first sheet group and is waiting on the sub conveyance path 142. Thus, an image forming apparatus 101 in which multiple sheets are not likely to contact is provided. By avoiding such a collision, misprints are reduced, and therefore the image forming apparatus 101 can continue printing. In other words, the productivity of the image forming apparatus 101 of the present embodiment is improved in comparison to the productivity of the image forming apparatus that executes mandatory discharging as a misprint.

As shown in FIG. 1 the image forming apparatus 101 is provided with the main conveyance path 141 on which sheets fed by the feeding roller 103 and the re-feeding rollers 120 are conveyed to the image forming unit 113. Furthermore, the post-processing conveyance path 144 is provided, which branches from the main conveyance path 141 downstream of the image forming unit 113 in the conveyance direction of the sheet, and on which sheets are conveyed to the post-processing apparatus 130. Furthermore, the sub conveyance path 142 is provided, which branches from the main conveyance path 141 downstream of the image forming unit 113 in the conveyance direction. Because sheets are fed once again to the image forming unit 113 by the re-feeding rollers 120, the sub conveyance path 142 is connected to the main conveyance path 141 upstream of the image forming unit 113 in the conveyance direction. The SB rollers 117 and the reverse conveyance path 145 are an example of a reversal unit for reversing the conveyance direction of a sheet on the sub conveyance path 142.

With the main CPU 201, sometimes the image forming unit 113 forms an image on the second surface (e.g., $\mathbf{3}_D$) of the final sheet in a first sheet group composed of multiple sheets to which post-processing is to be applied by the post-processing apparatus 130. When the image forming unit 113 forms an image on the second surface (e.g., $\mathbf{3}_D$) of the final sheet in the first sheet group, the time at which the successive sheet (e.g., $\mathbf{4}_D$) waiting on the sub conveyance path 142 is to be fed once again to the image forming unit 113 is delayed according to the post-processing time amount Tdly for the post-processing applied to the first sheet group. Note that the successive sheet (e.g., $\mathbf{4}_D$) is a sheet that is fed by the feeding roller 103 after the final sheet of the first sheet group and has an image formed on the first surface thereof. In this case, the main CPU 201 adjusts the feed time of the new sheet to be fed from the feeding roller 103 based on the post-processing time amount notified from the sub CPU 220. This adjustment is executed so that the new sheet (e.g., $\mathbf{5}_S$) fed from the feeding roller 103 does not contact with the successive sheet waiting on the sub conveyance path 142. Thus, collisions are prevented.

As shown in FIG. 5B and the like, the main CPU 201 adjusts the feed time of the sheet to be fed from the feeding roller 103 based on the post-processing time amount Tdly notified from the sub CPU 220 and the maximum value of the number of sheets that can wait on the sub conveyance path 142. Accordingly, the sheet fed from the feeding roller 103 is prevented from colliding with the sheet waiting on the sub conveyance path 142.

The maximum wait number W is the maximum value of the number of sheets that can wait on the sub conveyance path 142, and may be determined according to the length in the conveyance direction of the sheets and the length of the sub conveyance path 142. For example, as described above with reference to FIG. 4, the maximum value determination unit 204 may determine the maximum wait number W by dividing the conveyance path length L1 of the sub conveyance path 142 by the sheet length Lpap.

As described with reference to FIG. 7B and the like, when the maximum wait number W is zero, the main CPU 201 does not allow sheets to wait on the sub conveyance path 142. Furthermore, the main CPU 201 may adjust the feed time of the sheet (e.g., $\mathbf{5}_S$) to be fed from the feeding roller 103 based on the post-processing time amount Tdly notified from the sub CPU 220. For example, an A3-sized sheet or the like is longer than an A4-sized sheet. If the size of the image forming apparatus 101 is made compact, sometimes the sheet length Lpap is longer than the conveyance path length L1 of the sub conveyance path 142. In such a case, the maximum wait number W may be zero. Accordingly, even when the maximum wait number W is zero, the feed time of the sheet (e.g., $\mathbf{5}_S$) to be fed from the feeding roller 103 is adjusted based on the post-processing time amount Tdly. Thus, sheet collision is avoided, and misprints are reduced.

As described with reference to FIG. 5B, when the maximum wait number W is 1 or more in the sub conveyance path 142, the main CPU 201 allows a sheet to wait on the sub conveyance path 142. Furthermore, the main CPU 201 adjusts the feed time of the sheet to be fed from the feeding roller 103 based on the post-processing time amount Tdly notified from the sub CPU 220. Accordingly, the sheet fed from the feeding roller 103 is prevented from colliding with the sheet waiting on the sub conveyance path 142.

Thus, a feed mode that is executed when the maximum wait number W is zero and a feed mode that is executed when the maximum wait number W exceeds zero may be prepared. The main CPU 201 selects the feed mode according to whether or not the maximum wait number W is zero. The feed mode in FIG. 5A has a higher productivity than the feed mode in FIG. 7A because the sheet intervals can be reduced in length.

As described with reference to FIG. 5B, the main CPU 201 delays the time at which the re-feeding roller 120 feeds the second sheet. This delay is executed so that the interval from the trailing edge of the first sheet (e.g., $\mathbf{3}_D$) with an image formed on its second surface to the leading edge of the second sheet (e.g., $\mathbf{4}_D$) with an image formed on its second surface corresponds to the post-processing time amount Tdly. Also, the main CPU 201 delays the time at which the feeding roller 103 feeds the third sheet. This delay is executed so that the interval from the trailing edge of the third sheet (e.g., $\mathbf{5}_S$) fed by the feeding roller 103 to the leading edge of the second sheet (e.g., $\mathbf{4}_D$) fed by the re-feeding rollers 120 is the predetermined sheet interval Tds, which is set for continuous image formation. Accordingly, a decrease in productivity can be suppressed and sheet collision can be avoided.

As described with reference to FIGS. 5A and 5B, the image forming unit 113 may alternatingly execute image formation on a first surface of a sheet and image formation on a second surface of another sheet. Accordingly, the number of images formed per unit time increases. As described with reference to FIGS. 5A and 5B, the feeding roller 103 may continuously feed multiple sheets until the number of sheets actually waiting on the sub conveyance path 142 reaches the maximum wait number W. When the number of sheets waiting on the sub conveyance path 142 reaches the maximum wait number W, the feeding roller 103 may feed sheets alternatingly with the re-feeding rollers 120. Accordingly, the number of images formed per unit time increases.

As described with reference to FIG. 2, the fixing device 114 and the SB rollers 117 are driven by the same driving source. For this reason, the SB rollers 117 also continue operating while the fixing device 114 operates. For this reason, sheets cannot be allowed to wait on the reverse conveyance path 145 for a long amount of time. In such a case, conveyance control for avoiding the above-described sheet collision is useful.

Note that in the above-described embodiment, a configuration was described in which the motor 205 drives both the fixing device 114 and the SB rollers 117. However, the present invention is not limited thereto. For example, motors that drive the fixing apparatus 114 and the SB rollers 117 respectively may be provided individually. Also, the present invention can be applied to a configuration in which the motors continuously rotate without stopping during image formation.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-246635, filed Dec. 17, 2015, and No. 2016-210839, filed Oct. 27, 2016, which are hereby incorporated by reference herein in their entirety.

What is claimed is:

1. An image forming apparatus, comprising:

a first feeding unit configured to feed a sheet having a first surface and a second surface on which no image has been formed;

a second feeding unit configured to feed a sheet having a first surface on which an image has been formed;

a feeding control unit configured to control the first feeding unit and the second feeding unit;

an image forming unit configured to form an image on the first surface of the sheet fed by the first feeding unit and to form an image on a second surface of the sheet fed by the second feeding unit;

a reversal unit configured to reverse a conveyance direction of a sheet that was fed by the first feeding unit and has a first surface on which an image has been formed, and to convey the sheet with the first surface on which the image has been formed to the second feeding unit;

a post-processing unit configured to apply post-processing to a sheet; and a post-processing control unit configured to control the post-processing unit, wherein based on a post-processing time amount notified from the post-processing control unit, the feeding control unit adjusts a feed time of a sheet fed from the first feeding unit so that the sheet fed from the first feeding unit does not contact with a sheet waiting in the second feeding unit in a state where the sheet fed from the first feeding unit cannot wait at the reversal unit, and wherein the first feeding unit continuously feeds a plurality of sheets until a number of sheets waiting on a sub conveyance path reaches a maximum wait number, and when the number of sheets waiting on the sub conveyance path reaches the maximum wait number, the first feeding unit feeds a sheet alternatingly with the second feeding unit.

2. The image forming apparatus according to claim 1, comprising:

a main conveyance path through which sheets fed by the first feeding unit and the second feeding unit are conveyed to the image forming unit;

a post-processing conveyance path that branches from the main conveyance path downstream of the image forming unit in a sheet conveyance direction, and through which the sheets are conveyed to the post-processing unit; and a sub conveyance path, which is a conveyance path on which the second feeding unit is provided, the sub conveyance path branching from the main conveyance path downstream of the image forming unit in the conveyance direction, and being connected to the main conveyance path upstream of the image forming unit in the conveyance direction so that sheets are fed by the second feeding unit once again to the image forming unit, wherein the reversal unit reverses the conveyance direction of the sheet on the sub conveyance path.

3. The image forming apparatus according to claim 2, wherein the post-processing unit applies post-processing to a sheet group composed of a plurality of sheets with images formed on both the first surfaces and second surfaces thereof, and when the image forming unit forms an image on a second surface of a final sheet in a first sheet group composed of multiple sheets to which post-processing is to be applied by the post-processing unit, if a time at which a successive sheet, which has been fed from the first feeding unit after the final sheet, has a first surface on which an image has been formed, and is waiting on the sub conveyance path, is to be fed once again to the image forming unit is to be delayed according to a post-processing time amount for post-processing to be applied to the first sheet group, the feeding control unit adjusts the feed time of a new sheet to be fed from the first feeding unit based on the post-processing time amount notified from the post-processing control unit, so that the new sheet to be fed from the first feeding unit does not come into contact with the successive sheet waiting on the sub conveyance path.

4. The image forming apparatus according to claim 2, wherein based on the post-processing time amount notified from the post-processing control unit and on a maximum value of a number of sheets that can wait on the sub conveyance path, the feeding control unit adjusts a feed time of a sheet to be fed from the first feeding unit so that the sheet to be fed from the first feeding unit does not come into contact with a sheet waiting on the sub conveyance path.

5. The image forming apparatus according to claim 4, wherein the maximum value of the number of sheets that can wait on the conveyance path is determined according to a length in the conveyance direction of the sheets and a length of the conveyance path.

6. The image forming apparatus according to claim 4, wherein when the maximum value of the number of sheets that can wait on the sub conveyance path is zero, the feeding control unit does not allow sheets to wait on the sub conveyance path, and adjusts the feed time of the sheet to be fed from the first feeding unit based on the post-processing time amount notified from the post-processing control unit.

7. The image forming apparatus according to claim 4, wherein when the maximum value of the number of sheets that can wait on the sub conveyance path is one or more, the feeding control unit allows a sheet to wait on the sub conveyance path, and adjusts the feed time of a sheet to be fed from the first feeding unit based on the post-processing time amount notified from the post-processing control unit, so that the sheet to be fed from the first feeding unit does not come into contact with the sheet waiting on the sub conveyance path.

8. The image forming apparatus according to claim 1, wherein the feeding control unit delays the feed time of a second sheet to be fed by the second feeding unit so that an interval from a trailing edge of a first sheet with a second surface on which an image has been formed to a leading edge of the second sheet with a second surface on which an image is to be formed is an interval corresponding to the post-processing time amount, and the feeding control unit delays the feed time of a third sheet to be fed by the first feeding unit so that an interval from a trailing edge of the third sheet fed by the first feeding unit to a leading edge of the second sheet fed by the second feeding unit is a predetermined sheet interval that is set for continuous image formation.

9. The image forming apparatus according to claim 1, wherein the image forming unit alternatingly executes image formation on a first surface of a sheet and image formation on a second surface of another sheet.

10. The image forming apparatus according to claim 1, wherein the image forming unit has a fixing unit configured to fix a toner image to a sheet, and the fixing unit and the reversal unit are driven by the same driving source, and while the fixing unit operates, the reversal unit also continues operation.

* * * * *